US010499715B2

(12) United States Patent
Jin

(10) Patent No.: US 10,499,715 B2
(45) Date of Patent: Dec. 10, 2019

(54) INTELLIGENT OUTDOOR UMBRELLA

(71) Applicant: Linhai Zhongtian Electronic Appliance co., ltd, Linhai, Zhejiang (CN)

(72) Inventor: Shimin Jin, Zhejiang (CN)

(73) Assignee: Linhai Zhongtian Electronic Appliance Co., Ltd, Linhai (CN)

( * ) Notice: Subject to any disclaimer, the term of this patent is extended or adjusted under 35 U.S.C. 154(b) by 0 days.

(21) Appl. No.: 15/995,010

(22) Filed: May 31, 2018

(65) Prior Publication Data

US 2019/0037985 A1 Feb. 7, 2019

(30) Foreign Application Priority Data

Aug. 7, 2017 (CN) ..... 2017 1 0665559

(51) Int. Cl.
*A45B 17/00* (2006.01)
*A45B 25/14* (2006.01)
*A45B 25/00* (2006.01)

(52) U.S. Cl.
CPC ..... *A45B 17/00* (2013.01); *A45B 25/143* (2013.01); *A45B 2025/003* (2013.01); *A45B 2200/1009* (2013.01)

(58) Field of Classification Search
CPC ..... A45B 17/00; A45B 25/14
USPC ..... 135/20.3, 74, 20.1
See application file for complete search history.

(56) References Cited

U.S. PATENT DOCUMENTS 2,475,406 A * 7/1949 Russell ..... A45B 17/00 135/74
2,595,697 A * 5/1952 Pereira ..... A45B 17/00 135/20.3
2,607,363 A * 8/1952 Frey ..... A45B 17/00 135/74
2,661,012 A * 12/1953 Militano ..... A45B 17/00 135/74
2,721,569 A * 10/1955 Militano ..... A45B 17/00 135/20.3
3,129,715 A * 4/1964 Militano ..... A45B 17/00 135/20.3
3,311,119 A * 3/1967 Pearlstine ..... A45B 17/00 135/20.3
7,407,178 B2 * 8/2008 Freedman ..... A45B 11/00 135/20.3

(Continued)

*Primary Examiner* — Noah Chandler Hawk
(74) *Attorney, Agent, or Firm* — Wayne & Ken, LLC; Tony Hom

(57) ABSTRACT

The present invention discloses an intelligent outdoor umbrella, including an umbrella body, and angle adjustment mechanism configured to adjust an angle in a vertical direction, a rotation mechanism configured to adjust an angle in a horizontal direction, a lifting mechanism, an environment monitoring mechanism and a main controller. An angle of an outdoor umbrella is automatically adjusted to follow the change in the sun angle and better achieve the purpose of shading. The lifting mechanism enables the outdoor umbrella to fold and unfold automatically. The environment monitoring mechanism includes a solar assembly and a wind speed measurement device, the direction of sunlight and the wind speed are monitored and the measured related data is transmitted to the main controller.

9 Claims, 17 Drawing Sheets

(56) References Cited

U.S. PATENT DOCUMENTS

| | | | | |
|---|---|---|---|---|
| 7,631,653 | B2 * | 12/2009 | Young | A45B 17/00 135/15.1 |
| 8,291,923 | B2 * | 10/2012 | Young | A45B 11/00 135/20.1 |
| 8,607,714 | B2 * | 12/2013 | Ramberg | A45B 11/00 108/50.12 |
| 2009/0056775 | A1 * | 3/2009 | Kuelbs | A45B 3/04 135/16 |

* cited by examiner

INTELLIGENT OUTDOOR UMBRELLA

TECHNICAL FIELD

The present invention relates to the technical field of outdoor leisure and shading supplies and in particular to an intelligent outdoor umbrella.

BACKGROUND OF THE PRESENT INVENTION

An outdoor umbrella is a common shading supply in travel and leisure. It is simple to use and the umbrella cover folds and unfolds quickly and deftly. It offers a comfortable and cool space for people in outdoor activities. Since the stem is out of the umbrella, when the umbrella cover unfolds, the umbrella cover is high off the ground, the space below the umbrella cover is large, and the shading effect is great. Usually, for such an outdoor umbrella, a crank structure is arranged on the stem, and the rope is tightened or loosened by rotating the crank to control the umbrella cover to fold or unfold.

In an existing outdoor umbrella, the angle adjustment mechanism is simple and generally mechanical. For example, a tilting structure is provided on the bottom of the umbrella stem, and then the angle is adjusted by rotating the positioning tray. Such a structure cannot realize adjustment with large angle and free degree due to the limitation of the umbrella itself. In addition, a bent umbrella stem is provided, i.e. a so-called outdoor umbrella with a bent stem. For the outdoor umbrella with a bent stem, the angle still cannot be adjusted conveniently, and it is impossible to adjust the angle by 360 degrees when the counterweight is in a certain position; and the process of manufacturing the outdoor umbrella with a bent stem is more complex, and it is not intelligent and is high in cost.

SUMMARY OF THE PRESENT INVENTION

In view of the problems in the prior art, the present invention discloses an intelligent outdoor umbrella, where the angle of the umbrella cover can be automatically adjusted and the umbrella cover can fold and unfold automatically, with high degree of automation, simple structure and convenient operation.

To achieve the purpose, the present invention discloses an intelligent outdoor umbrella, comprising:

an umbrella body comprising an umbrella fabric, an umbrella frame and an umbrella stem, wherein the umbrella frame is arranged at one end of the umbrella stem, the umbrella fabric is covered on the umbrella frame, and the umbrella frame folds and unfolds relative to the umbrella stem to drive the umbrella fabric to fold and unfold;

an angle adjustment mechanism arranged on the umbrella stem and configured to drive the umbrella frame and the umbrella fabric to be angularly connected relative to the umbrella stem in a vertical direction;

a lifting mechanism arranged on the umbrella stem and configured to control folding and unfolding of the umbrella frame;

an environment monitoring mechanism configured to monitor the direction of external sunlight and the change in wind speed, wherein the environment monitoring mechanism is arranged on the top of the umbrella frame, located outside of the umbrella fabric and electrically connected to a main controller; and the main controller configured to receive data from the environment monitoring mechanism and control the operation of the angle adjustment mechanism and the lifting mechanism.

Further, the angle adjustment mechanism comprises a pushrod, an upper connecting rod, a lower connecting rod, an upper connector and a lower connector; the upper connector is hinged to the lower connector by a connecting pin, the upper connector is fixedly connected to the upper connecting rod, and the lower connector is fixedly connected to the lower connecting rod; the pushrod comprises a pushrod body and a telescopic rod, the pushrod body is connected to the lower connecting rod, and one end of the telescopic rod is inserted into the pushrod body and the other end thereof is fixedly connected to the upper connecting rod; the pushrod is connected to the main controller, and the main controller controls the telescopic movement of the telescopic rod in an up-down direction within the pushrod body so as to control the upper connecting rod to rotate relative to the lower connecting rod to adjust an angle of the umbrella frame and the umbrella fabric relative to the ground.

Further, the umbrella stem comprises an upper umbrella stem and a lower umbrella stem; one end of the upper umbrella stem is connected to the upper connecting rod and the other end thereof is connected to the umbrella frame; the lower connecting rod is sheathed on the lower umbrella stem on which a pushrod fixing hole is formed; a fixing pin and a fixing pin hole are provided on the lower connecting rod; and the pushrod fixing hole is aligned with the fixing pin hole, and the fixing pin is inserted so that the lower connecting rod is fixed on the lower umbrella stem.

Further, multiple pushrod fixing holes, which are arranged top and bottom, are formed on the lower umbrella stem, and the fixing pin hole is manually aligned with a pushrod fixing hole to adjust an angle of the umbrella frame and the umbrella fabric relative to the ground.

Further, the intelligent outdoor umbrella further comprises a rotation mechanism provided on a tray and configured to drive the umbrella body to rotate in a horizontal direction to follow the change in movement of sunlight, wherein the rotation mechanism is arranged on the umbrella stem and comprises a drive motor, a gear assembly and a tray assembly; the tray assembly is connected to the umbrella stem; the gear assembly is sheathed on the tray assembly; the drive motor is electrically connected to the main controller; and the drive motor drives the gear assembly to rotate and then drives rotation of the tray assembly connected to the gear assembly, thus driving the umbrella stem to rotate.

Further, the gear assembly comprises a first gear and a third gear transversely provided, and a second gear perpendicular to the first gear and the third gear, wherein the first gear and the third gear are arranged in parallel, and the second gear is engaged with both the first gear and the third gear; the second gear is connected to the tray, the first gear is connected to the drive gear, the drive motor controls the first gear to rotate thus to drive the second gear to rotate, and the second gear drives the tray assembly to rotate; a bearing is provided between the first gear, the second gear and the third gear.

Further, the tray assembly comprises the tray connected to the second gear, a tray holder supporting the tray, and a tray shaft providing the tray and the gear assembly with rotation support, wherein the first gear, the second gear and the tray are all sheathed on the tray shaft, and the tray drives the umbrella stem to rotate relative to the tray shaft thus to adjust the horizontal direction of the umbrella stem and the umbrella fabric.

Further, the outer side of the tray has a saw-toothed structure and is in engaged connection with a tray brake, and the tray brake is pressed down to control rotation of the tray.

Further, the angle adjustment mechanism comprises a pushrod, a first connecting member, a second connecting member, a third connecting member, an elastic hose and a bearing assembly, wherein the pushrod, the first connecting member, the second connecting member, the third connecting member and the bearing assembly are all received within the elastic hose; one end of the pushrod is fixed on the third connecting member and the other end thereof is connected to the first connecting member after passing through the second connecting member, and the bearing assembly is arranged at a joint between the pushrod and the first connecting member; there are three pushrods connected to the main controller, and the main controller controls an angle at which the first connecting member is rotated by controlling a height of the three pushrods; the first connecting member is connected to the upper umbrella stem and the third connecting member is connected to the lower umbrella stem; and when the first connecting member is rotated, the upper umbrella stem and the umbrella frame fixed on the upper umbrella stem are driven to rotate by 360 degrees.

Further, the lifting mechanism comprises a clutch motor, a gear assembly and a screw assembly, wherein one end of the screw assembly is connected to the umbrella frame and the other end thereof is connected to the gear assembly, and the clutch motor is connected to the gear assembly; the clutch motor is electrically connected to the main controller; and the clutch motor controls the gear assembly to rotate in turn and drives the screw assembly to move up and down in aid of the bearing, thus driving the umbrella frame to fold or unfold.

Further, the gear assembly comprises a first gear in the middle, a second gear and a third gear which are respectively at two ends, and a gear sleeve for receiving the first gear, the second gear and the third gear; a thread structure is provided inside the gear sleeve, the second gear is connected to the screw assembly, and the first gear is perpendicular to and engaged with the thread structure on the gear sleeve; the second gear and the third gear are both engaged with the first gear and the third gear is connected to the clutch motor; the clutch motor controls the third gear to rotate, the third gear drives the first gear to rotate, and the first gear drives the second gear to rotate, thus controlling the screw assembly to move up and down.

Further, the first gear is connected to a connecting shaft and the connecting shaft is connected to a crank provided on the umbrella stem; when the crank is rotated, the first gear is driven to move up and down relative to the gear sleeve, and the first gear drives the second gear to rotate, thus driving the screw assembly to move up and down.

Further, the environment monitoring mechanism comprises a solar assembly comprising a solar panel, a light sensor, a sunlight control panel and a battery, wherein the sunlight control panel is electrically connected to the main controller and configured to transform the collected solar energy into electric energy which is then stored in the battery to drive the main controller, and the sunlight control panel transfers light information detected by the light sensor to the main controller.

Further, the environment monitoring mechanism comprises a wind speed measurement device comprising a wind measurement vane, a frequency identification module and a wind speed sensing module, wherein the wind measurement vane is connected to the frequency identification module, and the frequency identification module and the wind speed sensing module are both connected to the main controller and transfer the monitored wind speed information.

Further, a wireless communication module is provided within the main controller and the wireless communication module wirelessly communicates with a remote client.

The present invention has the following beneficial effects:

1. by providing the angle adjustment mechanism and the rotation mechanism, the angle of an outdoor umbrella can be automatically adjusted to follow the change in the sun angle and better achieve the purpose of shading;

2. by adjusting the lifting mechanism, the umbrella frame folds and unfolds automatically, so the operation is simple and convenient;

3. by providing the environment monitoring mechanism comprising the solar assembly and the wind speed measurement device, the direction of sunlight and the wind speed are monitored and the measured related data is transmitted to the main controller, so that the angle adjustment mechanism, the rotation mechanism and the lifting mechanism can be automatically adjusted by the control of the main controller; the operation is simple and convenient because there is no need for manual operation;

4. by providing the wireless communication module which can be wirelessly communicated with the remote client, related state parameters of the outdoor umbrella are obtained by the remote client and the outdoor umbrella is remotely controlled, so the degree of automation is high and the operation is simple and convenient;

5. the rotation mechanism is accurately controlled by the solar assembly to freely adjust the position of the umbrella by 360 degrees, and the solar energy is transformed into electric energy required by the operation of the main controller and of various mechanisms by the solar assembly, so it is more environmentally friendly and more energy-saving; and 6. by providing the screw mechanism for the purpose of telescopic movement, the structure is simple and it is convenient for processing and assembling; and in combination with a wind control system, the angle of the umbrella cover can be intelligently adjusted at any time and in any place to accord with the wind, and the service life of the product is efficiently prolonged.

REFERENCE NUMERALS

10. umbrella body; 11. umbrella fabric; 12. umbrella frame; 13. umbrella stem; 14. crank;

131. upper umbrella stem; 132. lower umbrella stem;

20. angle adjustment mechanism; 21A. pushrod; 22A. upper connecting rod; 23A. lower connecting rod;

24A. upper connector; 25A. lower connector; 26A. connecting pin; 211A. pushrod body;

212A. telescopic rod; 231A. fixing pin hole; 232A. fixing pin;

30. lifting mechanism; 31. clutch motor; 32. gear assembly; 33. screw assembly; 34. bearing;

40. environment monitoring mechanism; 41. solar assembly; 42. wind speed measurement device;

50. main controller;

60. rotation mechanism; 61. drive motor; 62. gear assembly; 63. tray assembly;

64. shield; 65. supporting assembly;

70. counterweight assembly; 71. support; 72. counterweight.

DETAILED DESCRIPTION OF THE PRESENT INVENTION

The present invention will be further described below with reference to the accompanying drawings.

The present invention discloses an intelligent outdoor umbrella with adjustable angle and height, which is simple in structure, easy to operate, and convenient to fold and unfold.

Figure 1:
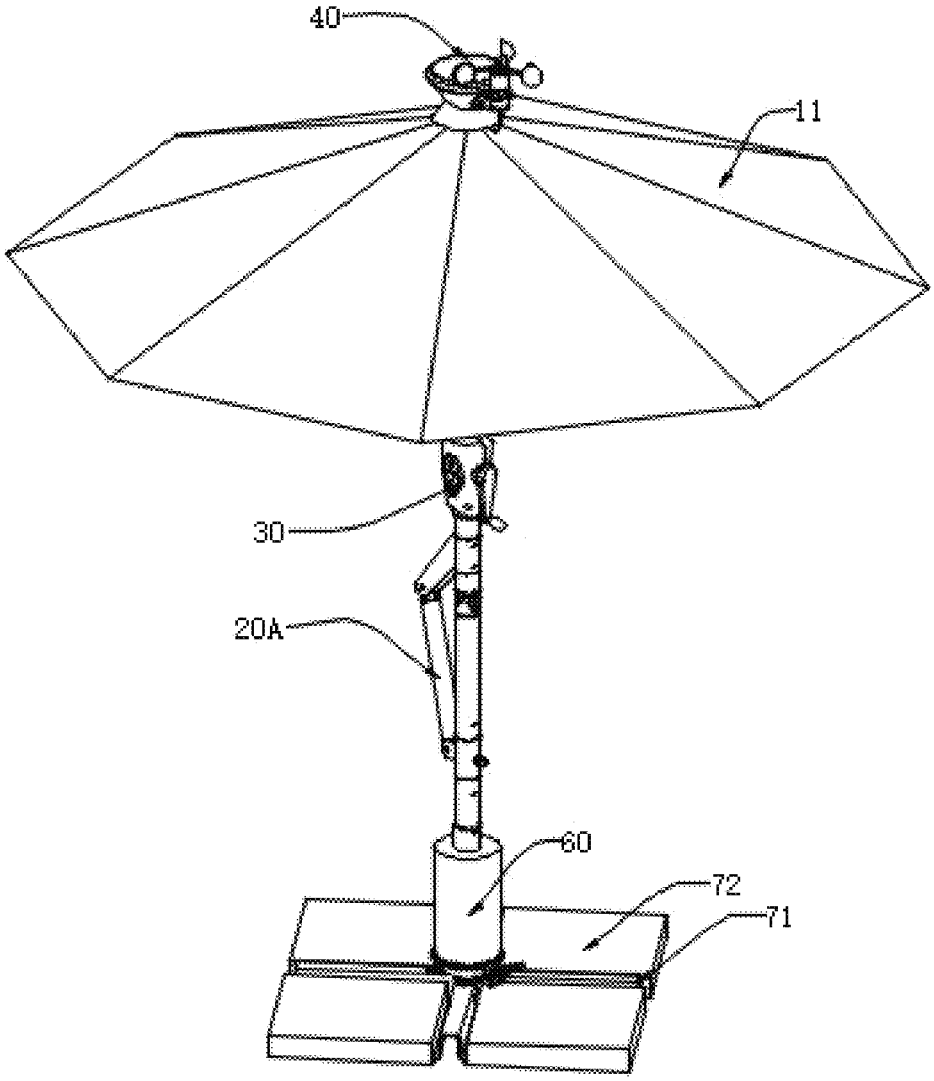
FIG. 1 is a schematic view of the whole structure according to a first embodiment of the present invention.
Figure 2:
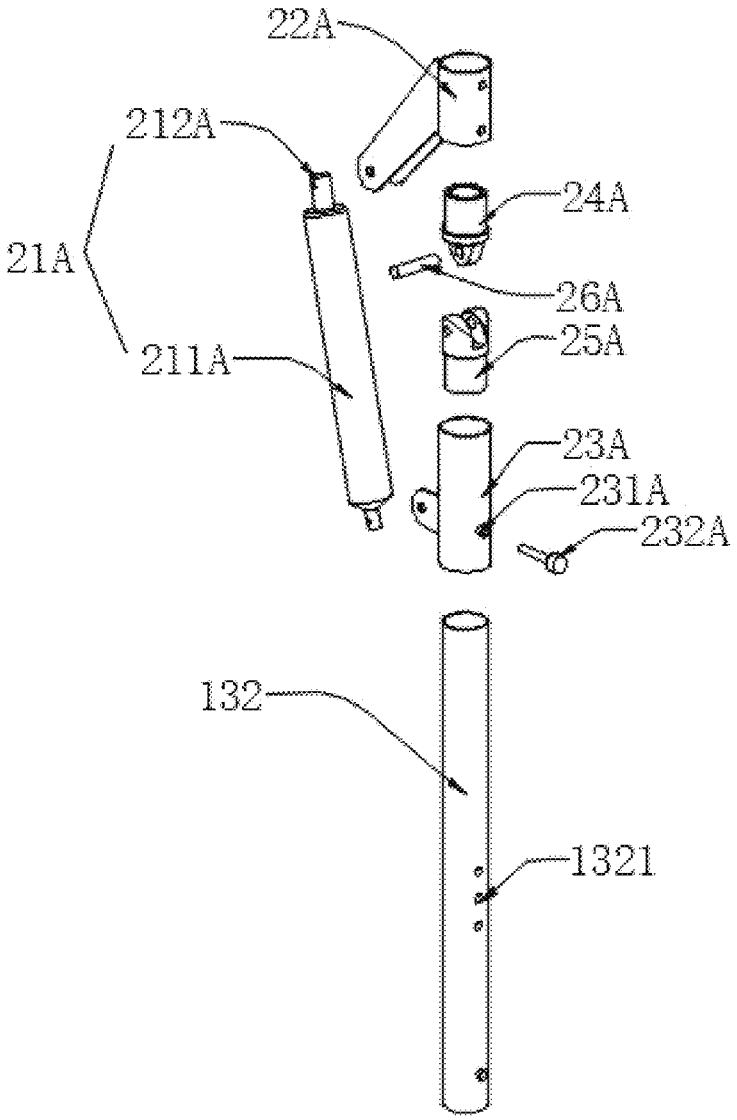
FIG. 2 is an exploded view of a first embodiment of an angle adjustment mechanism according to the present invention.
Figure 3:
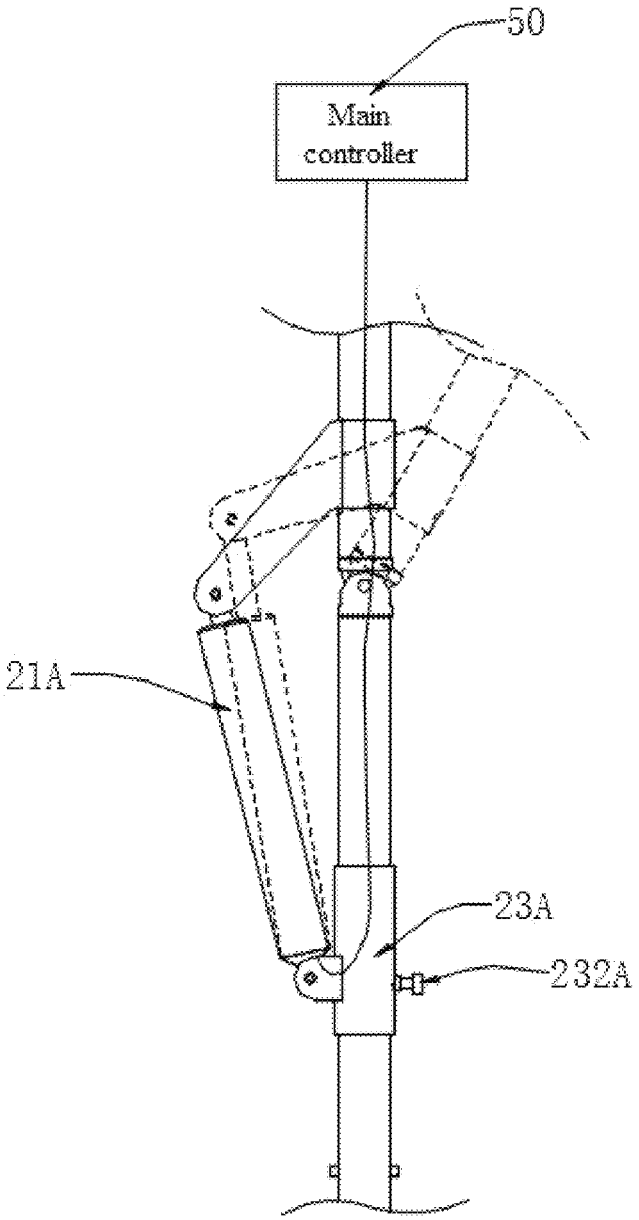
FIG. 3 is a schematic view of angle adjustment by using the angle adjustment mechanism according to the present invention.
Figure 4:
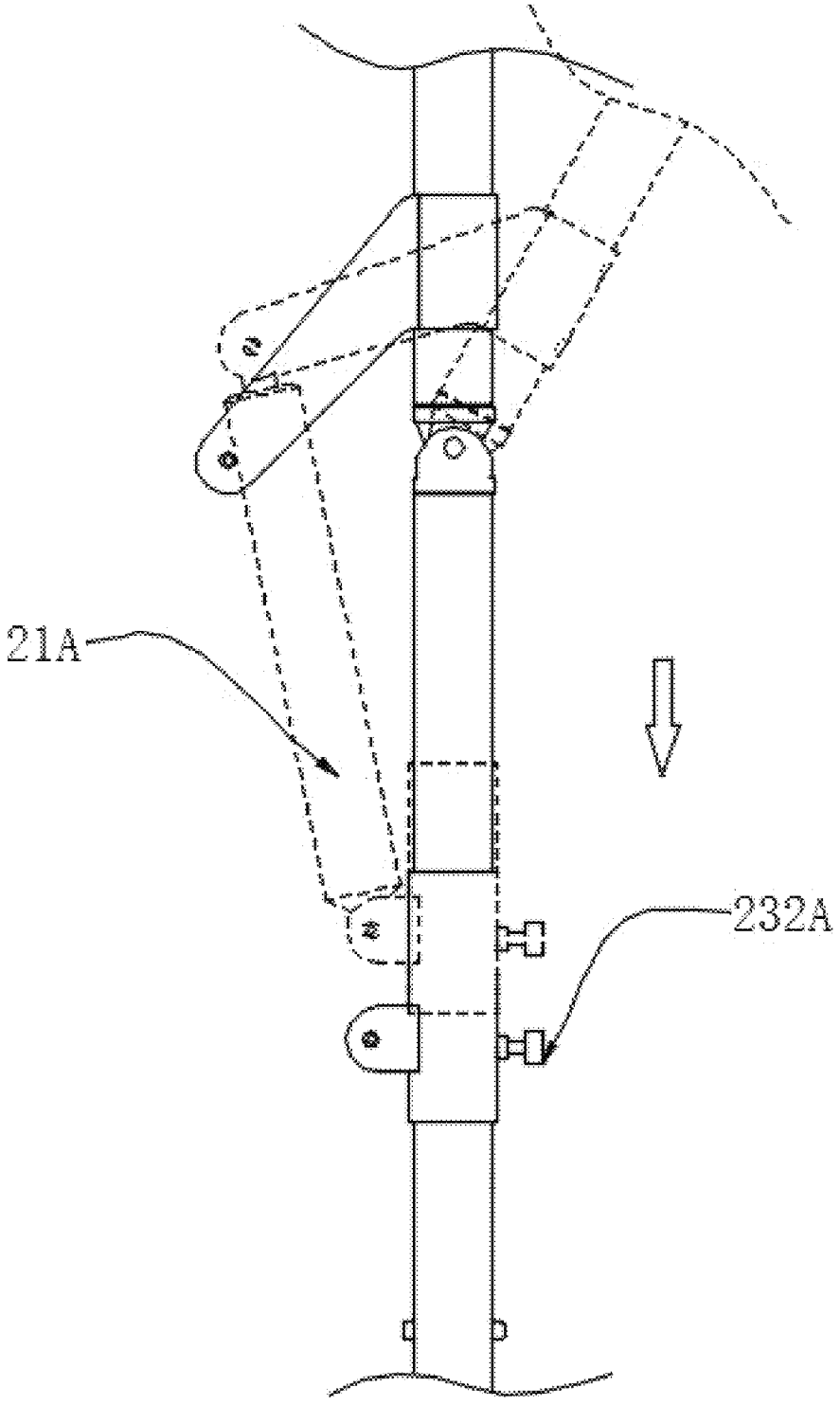
FIG. 4 is a schematic view of manual adjustment by using the angle adjustment mechanism according to the present invention.

Referring to FIG. 1, for this purpose, the present invention discloses an intelligent outdoor umbrella, comprising:

an umbrella body 10 comprising an umbrella fabric 11, an umbrella frame 12 and an umbrella stem 13, wherein the umbrella frame 12 is arranged at one end of the umbrella stem 13, the umbrella fabric 11 is covered on the umbrella frame 12, and the umbrella frame 12 folds and unfolds relative to the umbrella stem 13 to drive the umbrella fabric 11 to fold and unfold;

an angle adjustment mechanism 20 arranged on the umbrella stem 13 in a vertical direction and configured to drive the umbrella frame 12 and the umbrella fabric 11 to be angularly connected relative to the umbrella stem 13, and arranged on a tray 63 in a horizontal direction and configured to drive the umbrella body to follow the change in movement of sunlight;

a lifting mechanism 30 arranged on the umbrella stem 13 and configured to control folding and unfolding of the umbrella frame 12;

an environment monitoring mechanism 40 configured to monitor the direction of external sunlight and the change in wind speed, wherein the environment monitoring mechanism 40 is arranged on the top of the umbrella frame 12, located outside of the umbrella fabric 11 and electrically connected to a main controller 50; and the main controller 50 configured to receive data from the environment monitoring mechanism 40 and control the operation of the angle adjustment mechanism 20 and the lifting mechanism 30.

The outdoor umbrella according to the present invention has an automatic structure; by providing the angle adjustment mechanism and the rotation mechanism, an angle of the outdoor umbrella can be automatically adjusted to follow the change in the sun angle and better achieve the purpose of shading; by adjusting the lifting mechanism, the umbrella frame folds and unfolds automatically, so the operation is simple and convenient; by providing the environment monitoring mechanism, external environment related parameters are automatically monitored, thus controlling the operation of the angle adjustment mechanism and the rotation mechanism by the monitored related parameters, so the structure is simple and the operation is convenient.

The present invention discloses a structure by which angle adjustment can be automatically performed and the umbrella frame 12 folds and unfolds automatically. There are several control ways and two possible angle adjustment mechanisms will be described here.

Referring to FIG. 1 to FIG. 4, in Embodiment 1, an angle adjustment mechanism 20A by which the angle can be manually adjusted and also can be automatically adjusted is disclosed. A structure by which the angle is automatically adjusted comprises a pushrod 21A, an upper connecting rod 22A, a lower connecting rod 23A, an upper connector 24A and a lower connector 25A; wherein the upper connector 24A is hinged to the lower connector 25A by a connecting pin 26A, the upper connector 24A is fixedly connected to the upper connecting rod 22A, and the lower connector 25A is fixedly connected to the lower connecting rod 23A; the pushrod 21A comprises a pushrod body 211A and a telescopic rod 212A, the pushrod body 211A is connected to the lower connecting rod 23A, and one end of the telescopic rod 212A is inserted into the pushrod body 211A and the other end thereof is fixedly connected to the upper connecting rod 22A; the pushrod 21A is connected to the main controller 50, and the main controller 50 controls the telescopic movement of the telescopic rod 212A in an up-down direction within the pushrod body 211A so as to control the upper connecting rod 22A to rotate relative to the lower connecting rod 23A. The umbrella stem 13 comprises an upper umbrella stem 131 and a lower umbrella stem 132, one end of the upper umbrella stem 131 is connected to the upper connecting rod 22A and the other end thereof is connected to the umbrella frame 12; the lower connecting rod 23A is sheathed on the lower umbrella stem 132 on which a pushrod fixing hole 1321 is formed; a fixing pin 231A and a fixing pin hole 231A are provided on the lower connecting rod 23A; and the pushrod fixing hole 1321 is aligned with the fixing pin hole 231A, and the fixing pin 232A is inserted so that the lower connecting rod 23A is fixed on the lower umbrella stem 132. When the structures are fixed and the main controller 50 sends an instruction to adjust the angle, the telescopic rod 212A extends toward the upper connecting rod 22A; since the upper connector 24A can be rotated relative to the lower connector 25A and the telescopic rod 212A is of a steel structure, the telescopic rod 212A is connected to a extended section of the upper connecting rod 22A, and there is an angle between the telescopic rod 212A and the upper connecting rod 22A, so the telescopic rod 212A can drive the upper connecting rod 22A to rotate relative to the lower connecting rod 23A, thus driving the umbrella frame 12 connected to the upper connecting rod 22A to change its angle relative to the ground.

In this embodiment, a structure by which the angle is manually adjusted can be further provided. The specific structure is as follows: multiple pushrod fixing holes 1321, which are arranged top and bottom, are formed on the lower umbrella stem 132, the fixing pin hole 231A is manually aligned with a pushrod fixing hole 1321, and the position of the pushrod 21A relative to the lower connecting rod 23A is moved up and down to control the angle between the upper connecting rod 22A and the lower connecting rod 23A. For example, if there are three pushrod fixing holes 1321, when the lower connecting rod 23A is locked on the pushrod fixing hole 1321 in the middle, the upper connecting rod 22A and the lower connecting rod 23A are arranged in a straight line; when the lower connecting rod 23A is locked on the pushrod fixing hole 1321 in the uppermost, the pushrod 21A drives the upper connecting rod 22A to rotate to right; when the lower connecting rod 23A is locked on the pushrod fixing hole 1321 in the lowermost, the pushrod 21A drives the upper connecting rod 22A to rotate to left; the position where the lower connecting rod 23A is locked is manually adjusted and the lower connecting rod 23A is fixed on a corresponding pushrod fixing hole 1321 by the fixing pin 232A.

In Embodiment 2, referring to FIG. 5 to FIG. 8, the angle adjustment mechanism can perform adjustment only in two directions and this operation is simple. The present invention further discloses another angle adjustment mechanism 20B by which the angle can be adjusted by 360 degrees, comprising a pushrod 21B, a first connecting member 22B, a second connecting member 23B, a third connecting member 24B, an elastic hose 25B and a bearing assembly 26B, wherein the pushrod 21B, the first connecting member 22B, the second connecting member 23B, the third connecting member 24B and the bearing assembly 26B are all received within the elastic hose 25B. One end of the pushrod 21B is fixed on the third connecting member 24B and the other end thereof is connected to the first connecting member 22B after passing through the second connecting member 23B, and the bearing assembly 26B is arranged at a joint between the pushrod 21B and the first connecting member 22B; the pushrod 21B is connected to the main controller 50, the pushrod 21B comprises a pushrod body 211B and a telescopic rod 212B, and the main controller 50 controls the pushrod body 211B and the telescopic rod 212B to move up and down. In this embodiment, there are three pushrods, and the main controller controls an angle at which the first connecting member 22B is rotated by controlling the height of the pushrod body of the three pushrods and the telescopic movement of a corresponding telescopic rod. In this embodiment, referring to FIG. 6, the bearing assembly 26B comprises a single-rod ball joint bearing 261B and a connecting sleeve 262B, wherein the connecting sleeve is sheathed on the single-rod ball joint bearing 261B which enables the telescopic rod 212B to rotate relative to the first connecting member 22B thus to better control the angle at which the first connecting member 22B is rotated. In this embodiment, the first connecting member 22B is connected to the upper umbrella stem 131, and the third connecting member 24B is connected to the lower umbrella stem 132; and when the first connecting member 22B is rotated, the upper umbrella stem 131 and the umbrella frame 12 fixed on the upper umbrella stem 131 are driven to perform angle adjustment. Such a structure is helpful for the upper umbrella stem 131 to rotate by 360 degrees.

Figure 5:
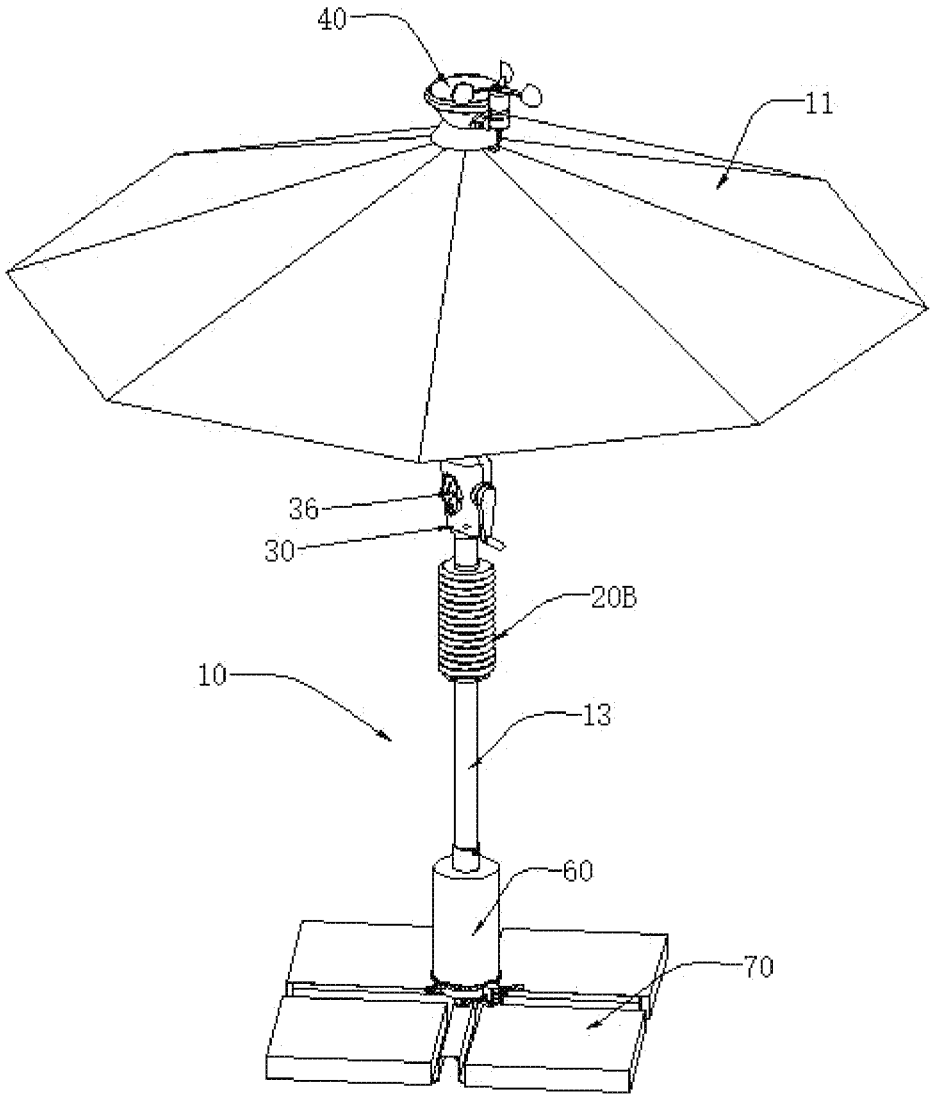
FIG. 5 is a schematic view of the whole structure according to a second embodiment of the present invention.
Figure 6:
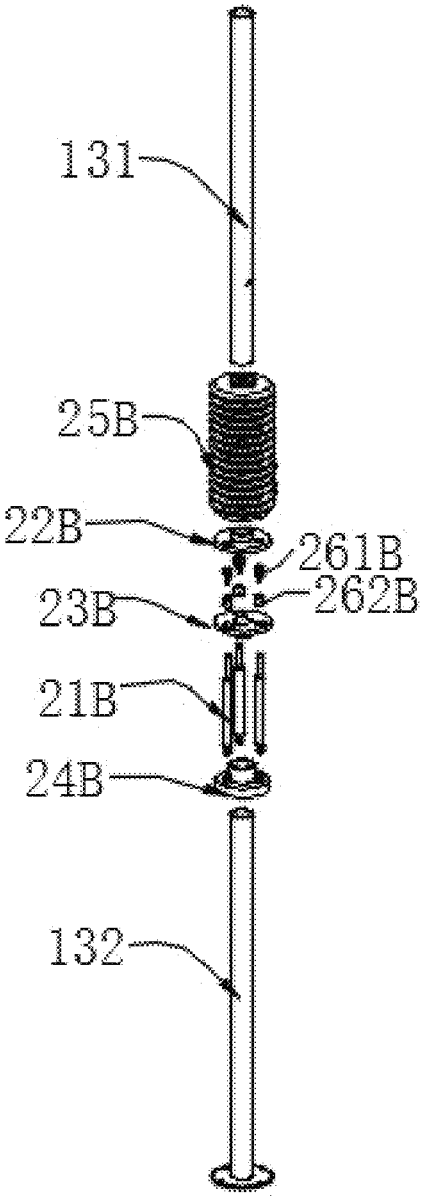
FIG. 6 is an exploded view of a second embodiment of the angle adjustment mechanism according to the present invention.
Figure 7:
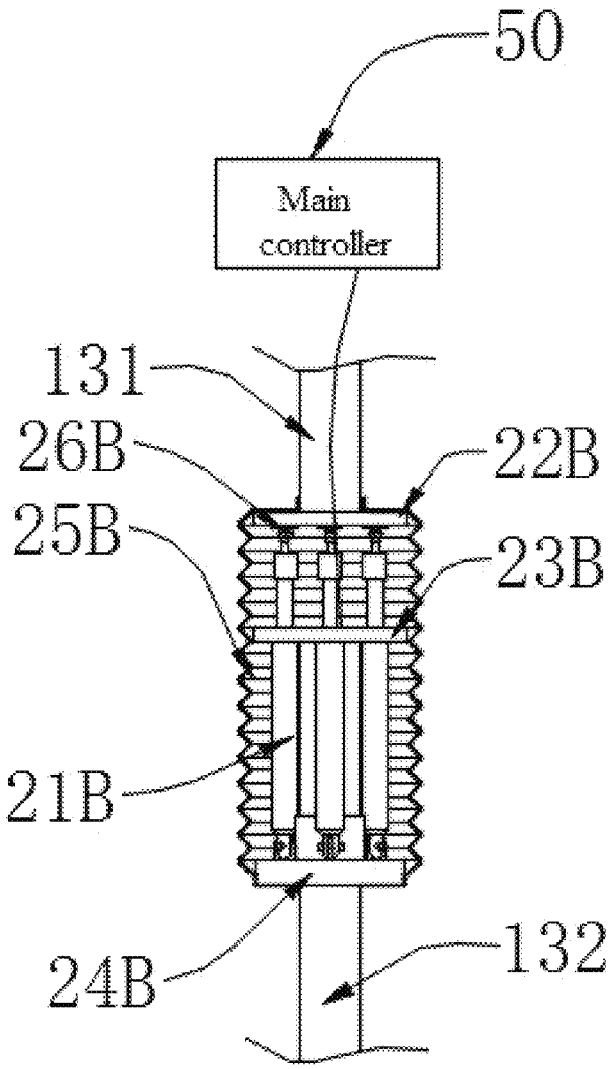
FIG. 7 is a sectional view of the second embodiment of the angle adjustment mechanism according to the present invention.
Figure 8:
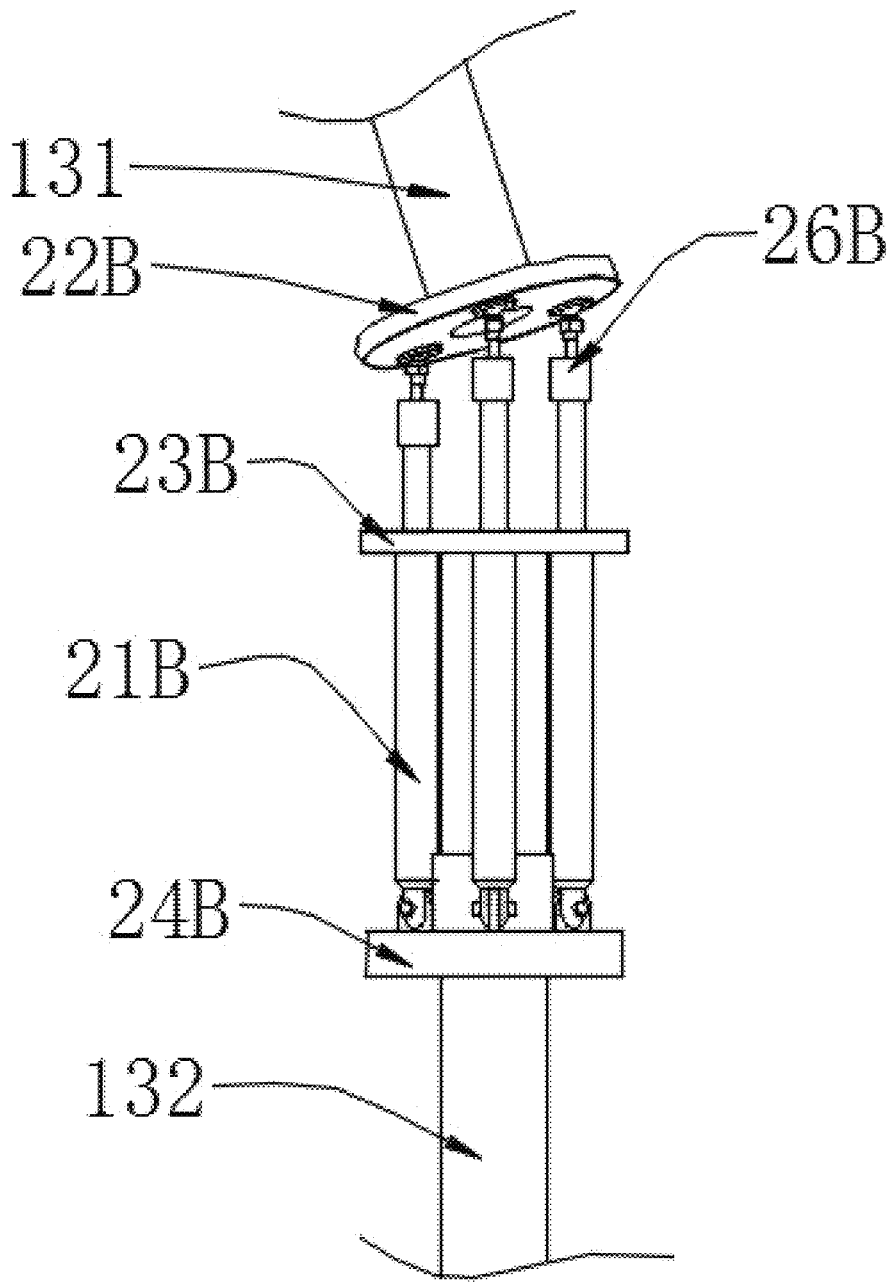
FIG. 8 is a schematic view of angle adjustment by using the second embodiment of the angle adjustment mechanism according to the present invention.
Figure 9:
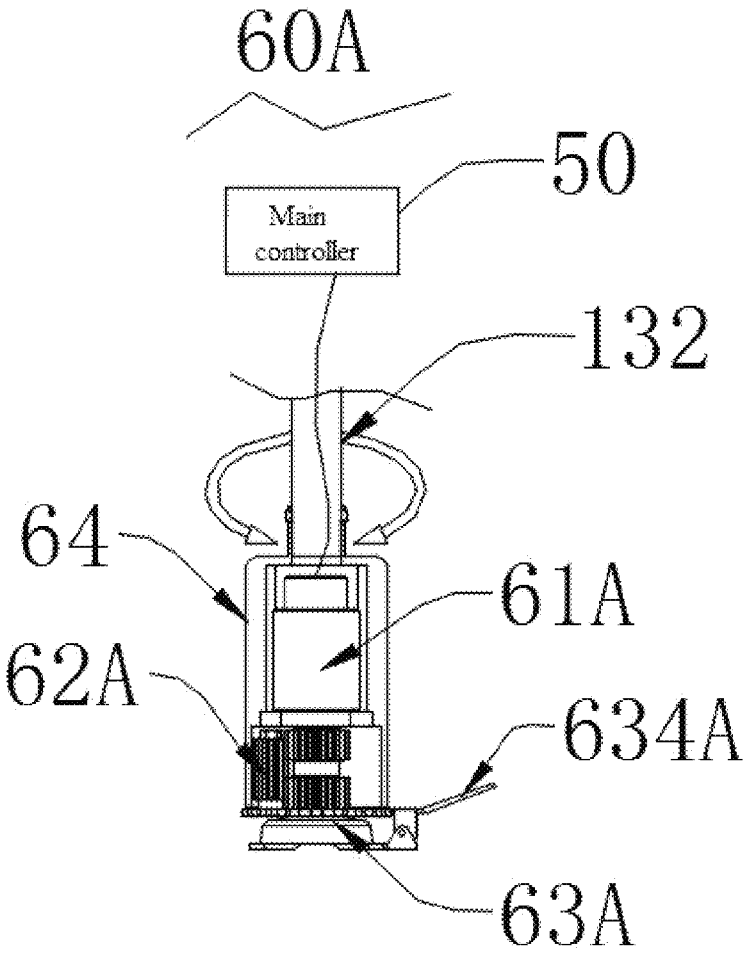
FIG. 9 is a schematic assembly diagram of a first embodiment of a rotation mechanism according to the present invention.
Figure 10:
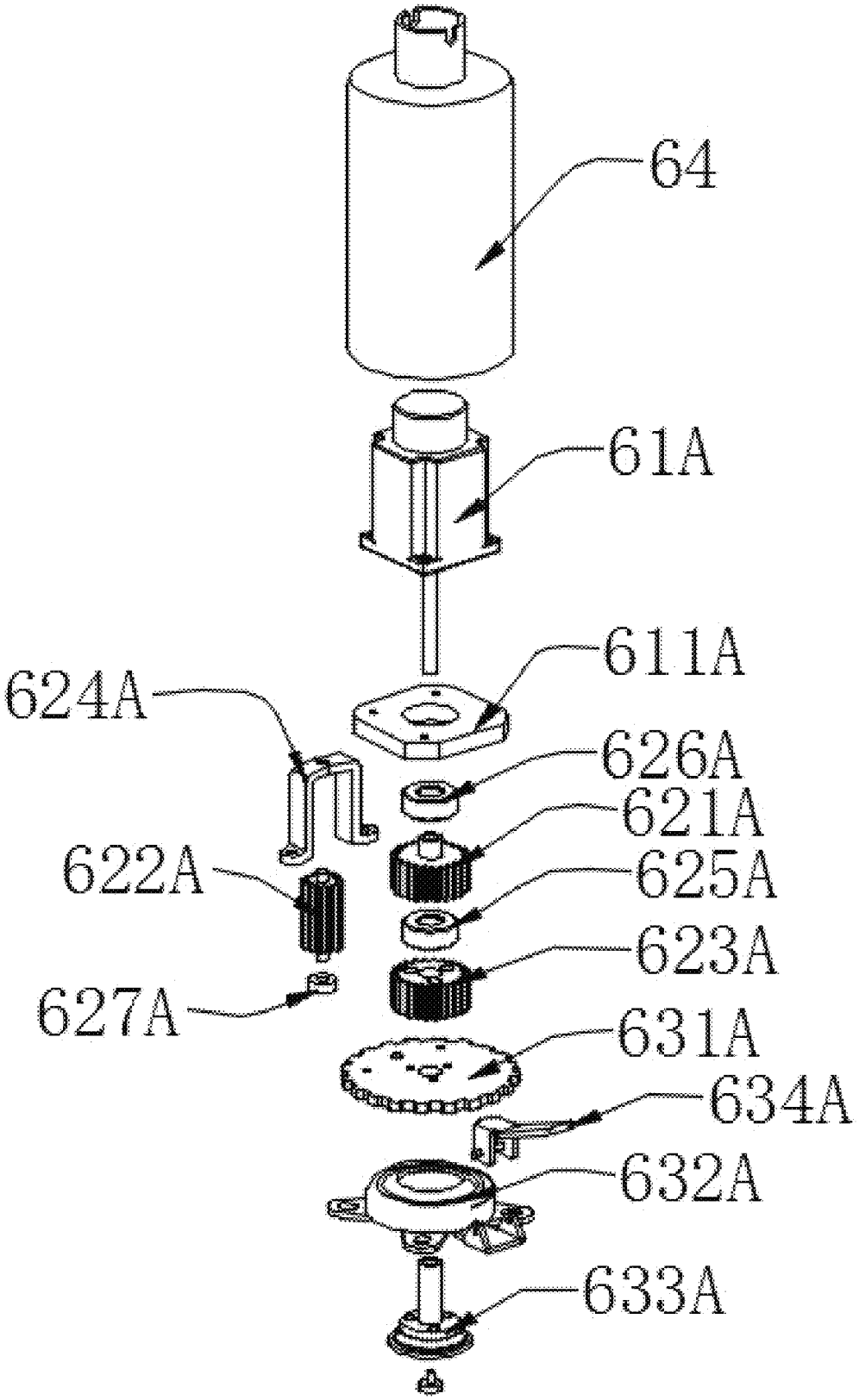
FIG. 10 is an exploded view of the first embodiment of the rotation mechanism according to the present invention.

Referring to FIG. 5 and FIG. 9 to FIG. 10, further, the present invention further comprises a rotation mechanism 60, wherein the rotation mechanism 60 is arranged on the umbrella stem 13, preferably arranged in a position of the lower umbrella stem 132. Generally, a large outdoor umbrella is fixed on a counterweight assembly 70. The counterweight assembly 70 comprises a support 71 and counterweights 72. The multiple counterweights 72 are fixed on the support 71. The lower umbrella stem 132 is inserted into the support 71 to be fixed. The rotation mechanism 60 is preferably located on the lower umbrella stem 132 in a position close to the counterweight assembly 70. In the present invention, the rotation mechanism 60 can be arranged as an automatic rotation mechanism 60A or as a manual rotation mechanism 60B. One rotation mechanism 60A which supports both manual rotation and automatic rotation will be described below.

In one embodiment, the rotation mechanism 60A comprises a drive motor 61A, a gear assembly 62A and a tray assembly 63A; the tray assembly 63A is connected to the lower umbrella stem 132; the gear assembly 62A is sheathed on the tray assembly 63A; the drive motor 61A is electrically connected to the main controller 50; and the drive motor 61A drives the gear assembly 62A to rotate and then drives rotation of the tray assembly 63A connected to the gear assembly 62A, thus driving the umbrella stem 13 to rotate.

Further, the gear assembly 62A comprises a first gear 621A and a third gear 623A transversely provided, and a second gear 622A perpendicular to the first gear 621A and the third gear 623A; the first gear 621A and the third gear 623A are arranged in parallel, and the second gear 622A is engaged with both the first gear 621A and the third gear 623A, and the second gear 622A is fixed by a gear seat 624A; a fourth thrust ball bearing 625A is provided between the first gear 621A and the third gear 623A; the drive motor 61A is preferably a stepper motor, and is connected to and fixed on the first gear 621A by a motor base 611A; and a third thrust ball bearing 626A is provided at a joint between the first gear 621A and the drive motor 61A. In this embodiment, the tray assembly 63A comprises a tray 631A connected to the second gear 622A, a tray holder 632A supporting the tray, and a tray shaft 633A providing the tray and the gear assembly 62A with rotation support. The first gear 621A, the third gear 623A and the tray 631A are all sheathed on the support 71 on the counterweight assembly 70, and the second gear 622A is fixedly connected to the tray 631A by a fifth thrust ball bearing 627A. The drive motor 61A drives the first gear 621A to rotate, and the first gear 621A drives the second gear 622A to rotate. Since the second gear 622A is connected to the third gear 623A and the tray 631A, the third gear 623A and the tray 631A are driven to rotate. The outer side of the tray 631A has a saw-toothed structure and is provided with a tray brake 634A, and the saw-toothed structure on the tray 631A is in engaged connection with the tray brake 634A. Since the tray 631A is locked by the tray brake 634A, the drive motor 61A is in a relative movement state and the drive motor 61A is fixedly connected to the lower umbrella stem 132 by a shield 64, the lower umbrella stem 132 is driven to rotate. Since the lower umbrella stem 132 cannot be rotated relative to the upper umbrella stem 131 in a vertical direction, the upper umbrella stem 131 and the lower umbrella stem 132 are rotated together, and the umbrella frame 12 is driven to rotate by 360 degrees.

Further, in this embodiment, rotation can also be manually driven. The tray brake 634A is pressed down, and the tray brake 634A is moved in the saw-toothed structure without movement of itself, thus the tray 631A is driven to rotate and then the lower umbrella stem 132 is driven to rotate, so that the umbrella frame 12 is rotated by 360 degrees.

Figure 11:
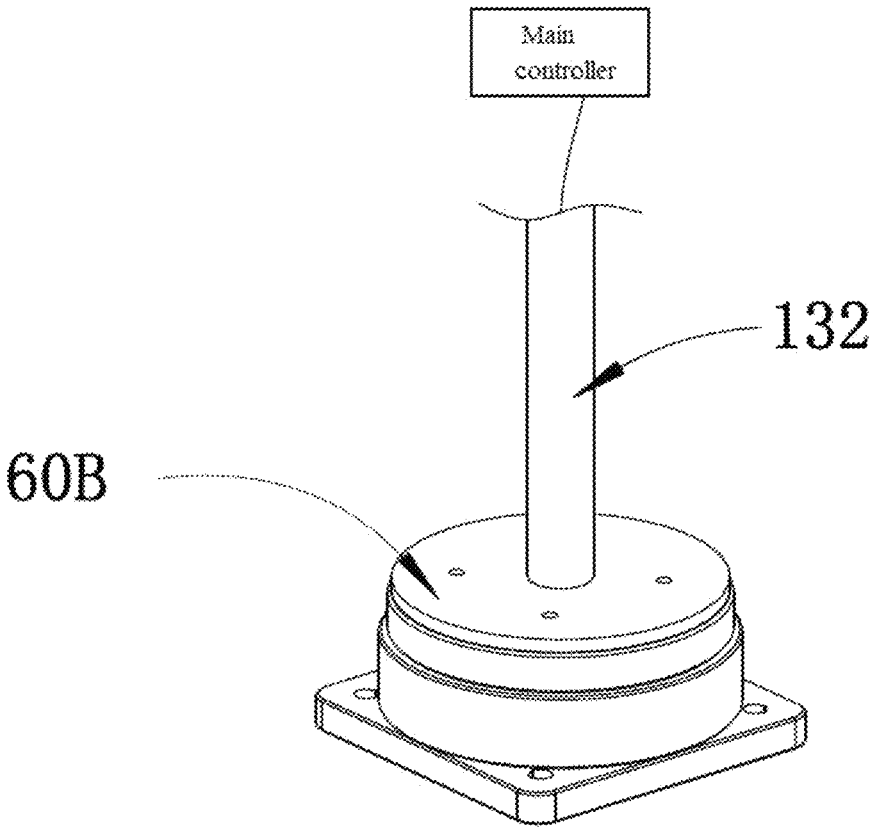
FIG. 11 is a schematic assembly diagram of a second embodiment of the rotation mechanism according to the present invention.
Figure 12:
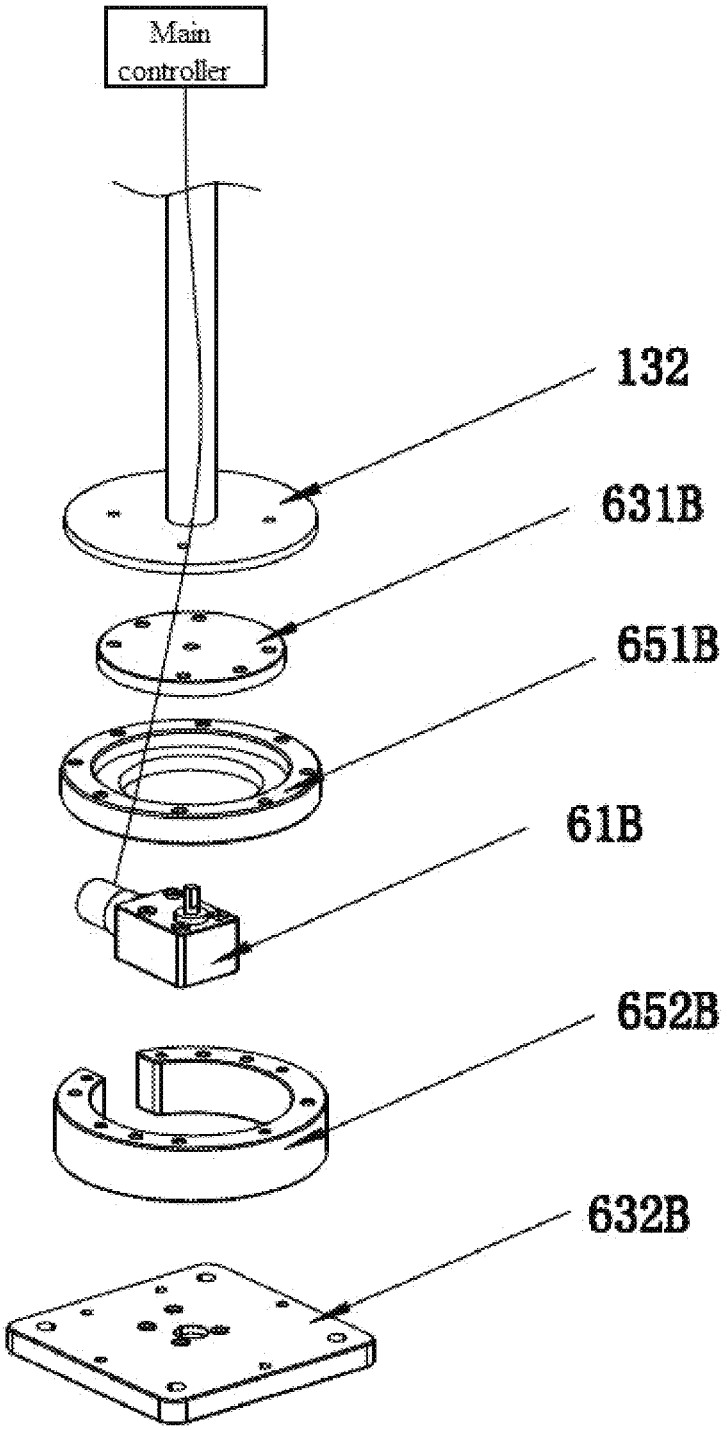
FIG. 12 is an exploded view of the second embodiment of the rotation mechanism according to the present invention.

Referring to FIG. 11 to FIG. 12, in another embodiment, there is another electric rotation mechanism 60B comprising a tray 631B, a mounted bearing 651B supporting the tray, a supporting ring 652B, a tray holder 632B and a drive motor 61B providing the tray with rotation. The tray 631B is in shaft connection with the drive motor 61B and fixed on the lower umbrella stem 132, and the motor operates to drive the tray 631B and thus to drive the lower umbrella stem 132 to rotate.

Figure 13:
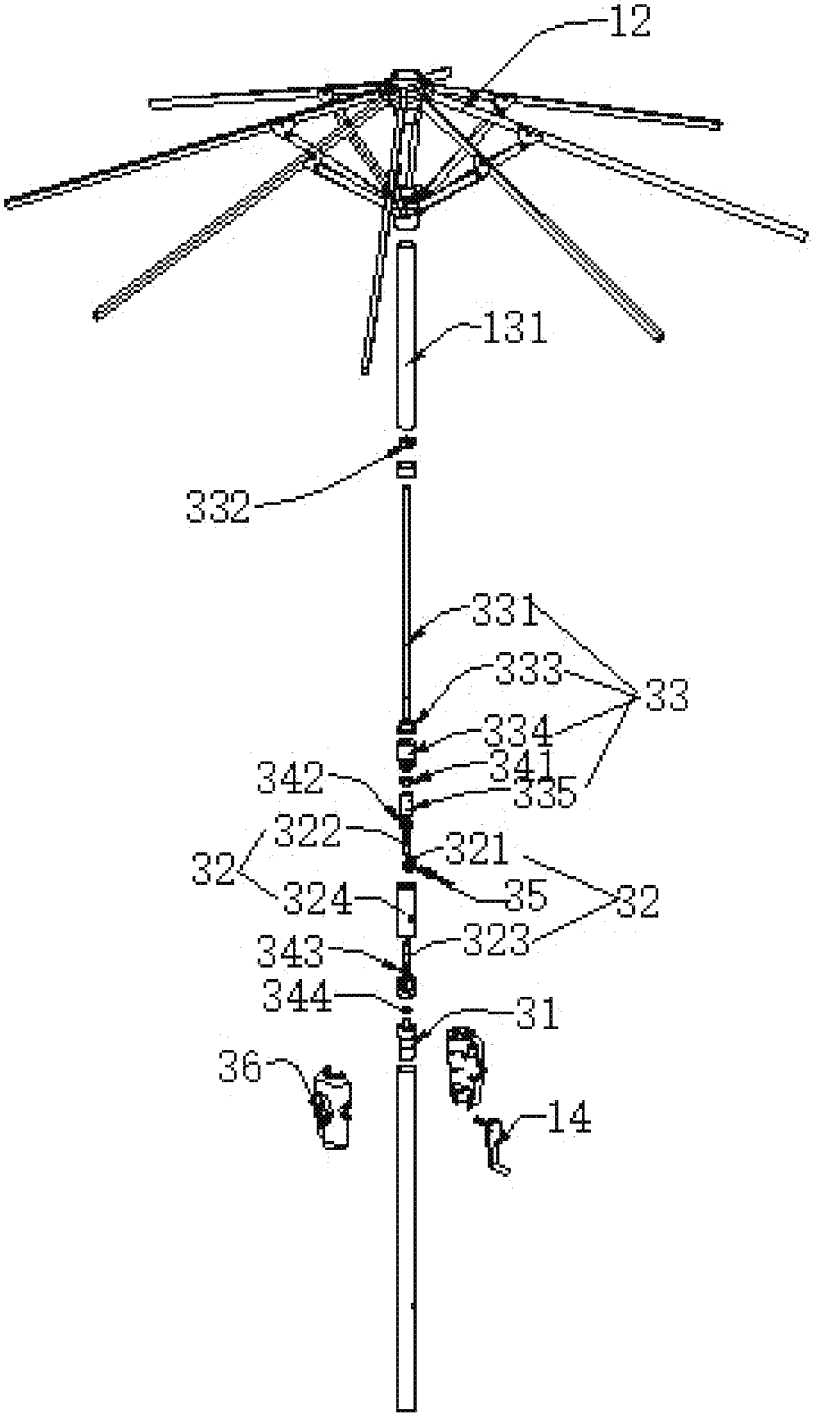
FIG. 13 is an exploded view of a lifting mechanism according to the present invention.
Figure 14:
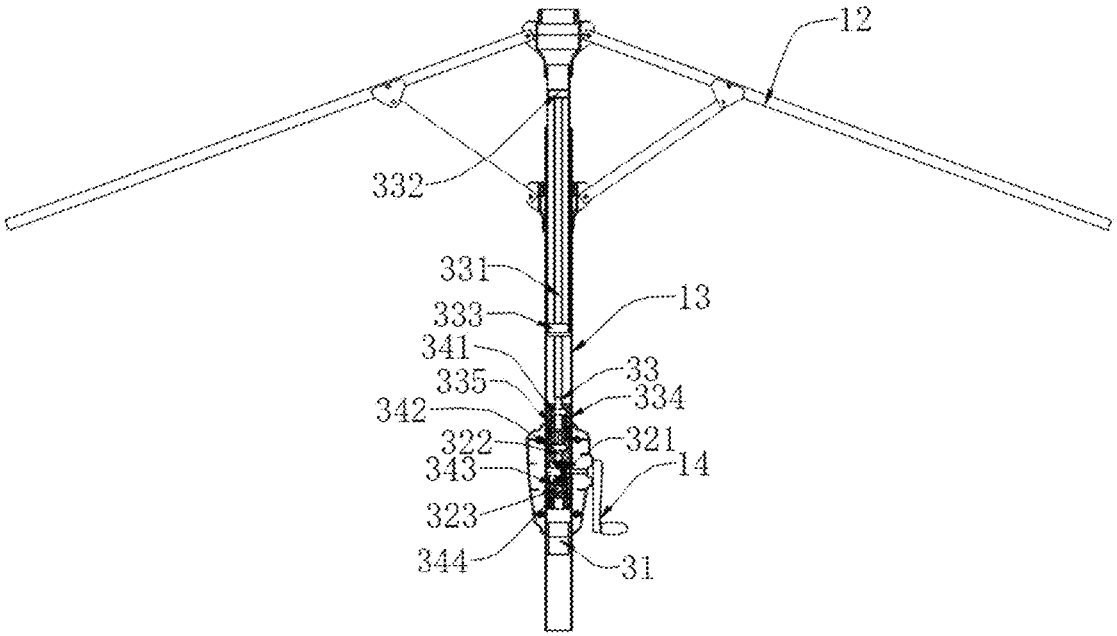
FIG. 14 is a sectional assembly view of the lifting mechanism according to the present invention.
Figure 15:
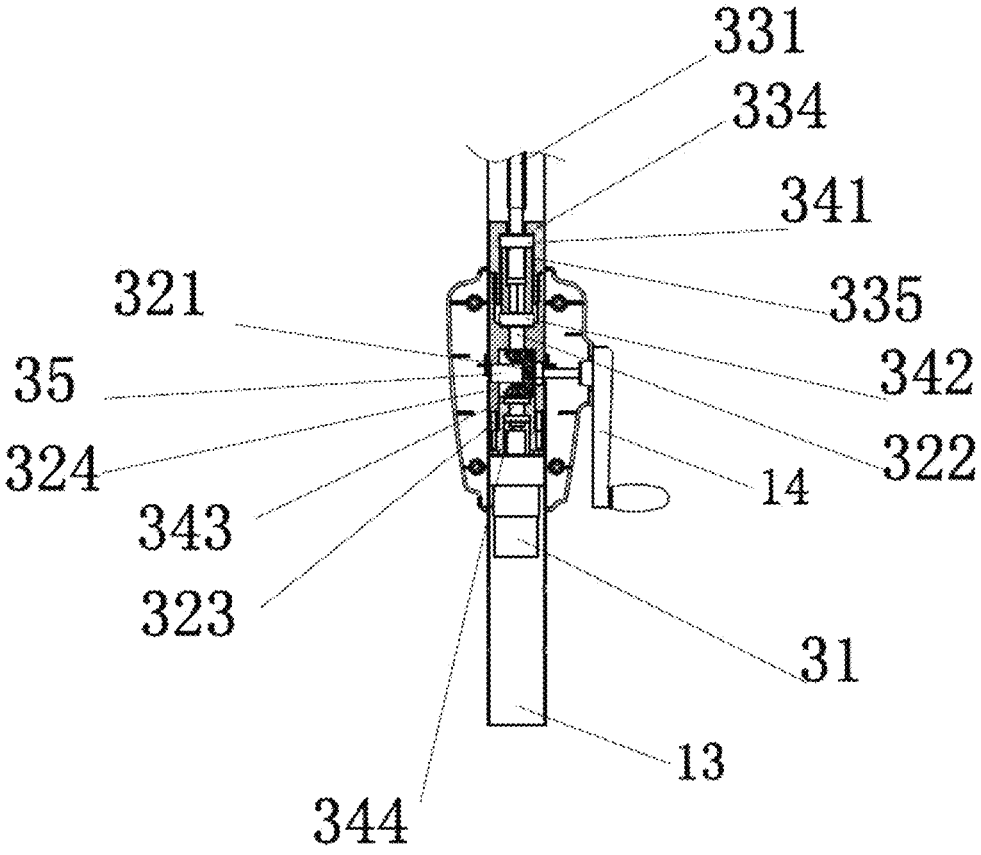
FIG. 15 is a partially enlarged view of the lifting mechanism according to the present invention.

Referring to FIG. 13 to FIG. 15, further, the lifting mechanism 30 according to the present invention comprises a clutch motor 31, a gear assembly 32 and a screw assembly 33. one end of the screw assembly 33 is connected to the umbrella frame 12 and the other end thereof is connected to the gear assembly 32, and the clutch motor 31 is connected to the gear assembly 32. The clutch motor 31 is electrically connected to the main controller 50 and the clutch motor 31 controls the gear assembly 32 to rotate in turn and drives the screw assembly 33 to move up and down in aid of the bearing 34, thus driving the umbrella frame 12 to fold or unfold. Further, a control button can be further provided on a housing on the outermost side of the lifting mechanism 30, and the operating state of the clutch motor 31 is controlled by controlling the control button 36.

In this embodiment, the gear assembly 32 comprises a first gear 321 in the middle, a second gear 322 and a third gear 323 which are respectively at two ends, and a gear sleeve 324 for receiving the first gear 321, the second gear 322 and the third gear 323. A thread structure is provided inside the gear sleeve 324, the second gear 322 is connected to the screw assembly 33, and the first gear 321 is perpendicular to and engaged with the thread structure on the gear sleeve 324. The second gear 322 and the third gear 323 are both engaged with the first gear 321 and the third gear 323 is connected to the clutch motor 31. The clutch motor 31 controls the third gear 323 to rotate, the third gear 323 drives the first gear 321 to rotate, and the first gear 321 drives the second gear 322 to rotate, thus controlling the screw assembly 33 to move up and down. Further, in this embodiment, the screw assembly 33 comprises a screw body 331, an upper screw fixing sleeve 332, a lower screw fixing sleeve 333, a screw fixing head 334 and a screw connecting sleeve 335. One end of the screw body 331 is connected to the screw fixing head 334 and the other end thereof is fixed on the upper screw fixing sleeve 332 after passing through the lower screw fixing sleeve 333.

The lower end of the screw fixing head 334 is connected to the screw fixing sleeve 335 having a hollow pipe structure with a first thrust bearing 341 and a second thrust bearing 342 respectively provided on its two openings, and the screw body 331 is connected to the second gear 322 by connecting the first thrust bearing and the second thrust bearing. When the second gear 322 is driven by the first gear 321 to rotate, the screw body 331 is rotated in aid of the first thrust bearing 341 and the second thrust bearing 342, and the lower screw fixing sleeve 333 connected to the screw body 331 is driven by rotation of the screw body 331 to move up and down. Since the lower screw fixing sleeve 333 is connected to the umbrella frame 12, the lower screw fixing sleeve 333 is moved down, thus the umbrella frame 12 is driven to unfold and the outdoor umbrella unfolds. The whole outdoor umbrella folds when the lower screw fixing sleeve 333 is moved up.

Further, the third gear 323 is connected to the clutch motor 31 in aid of a first deep groove ball bearing 343 and a second deep groove ball bearing 344 and is rotated by the driving of the drive motor 31. In this embodiment, the clutch motor 31 is electrically connected to the main controller 50, and the main controller 50 controls rotation of the clutch motor 31; the clutch motor 31 is rotated to drive the third gear 323 to rotate, and the third gear 323 is rotated to drive the first gear 321 to rotate, thus driving the second gear 322 to rotate; the second gear 322 is rotated, so that the lower screw fixing sleeve 333 connected thereto is moved down and then moved up, thus unfolding the outdoor umbrella.

By this structure, the outdoor umbrella is controlled to unfold automatically. In another embodiment, the present invention further discloses a lifting mechanism 30 by which the outdoor umbrella manually unfolds. Further, the first gear 321 is connected to a connecting shaft 35 and the connecting shaft 35 is connected to a crank 14 provided on the umbrella stem 13. When the crank 14 is rotated, the first gear 321 is driven to rotate, and the first gear 321 drives the second gear 322 to rotate, thus driving the screw assembly 33 to move up and down.

Figure 16:
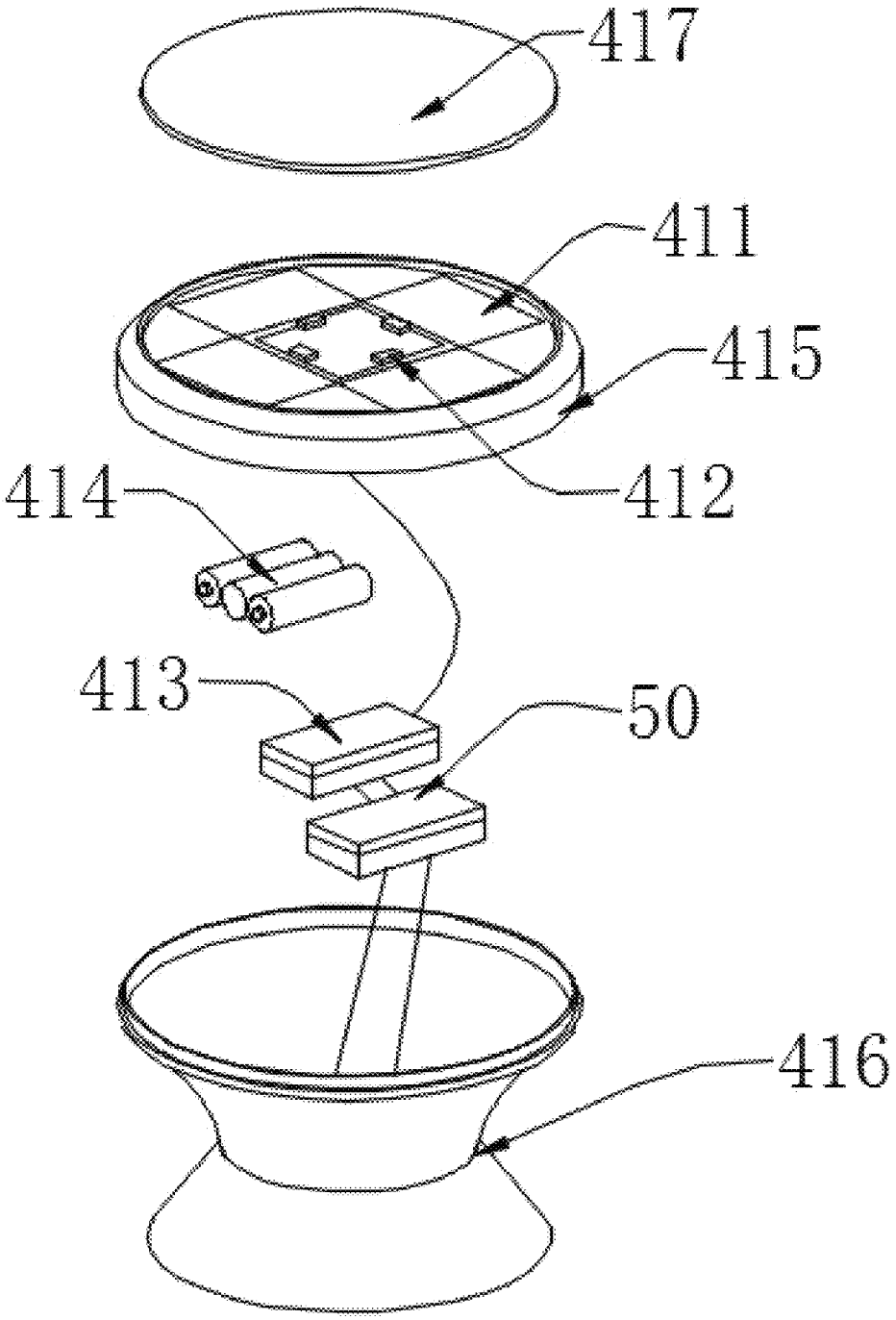
FIG. 16 is an exploded structure diagram of a solar assembly according to the present invention.

Referring to FIG. 16, further, the environment monitoring mechanism 40 comprises a solar assembly 41 comprising a solar panel 411, a light sensor 412, a sunlight control panel 413 and a battery 414. The light sensor 412 is received on the solar panel 411, there may be multiple solar panels 411, and multiple light sensors 412 are arranged on the solar panels 411, so it is helpful to monitor sunlight from multiple directions and angles and the monitored data is more accurate. In this embodiment, four light sensors 412 are arranged on four directions (i.e. east, west, south and north) on a same horizontal plane of the solar panel, sunlight shines on the solar panel 411, and the light sensors 412 sense the light intensity. When there is an included angel between the direction of sunlight and the vertical direction of the solar panel, the light intensity sensed by the four light sensors 412 is different, and the presented digital and electric effect reflects difference in voltage. The sunlight control panel 413 collects voltage data, calculates an average deviation, transforms it into a level signal, and transmits the signal to the main controller 50 for processing. After the signal is processed by the main controller 50, an execution signal is transmitted to an electric device to adjust and control the outdoor umbrella.

The solar panel 411 and the light sensors 412 are received in a middle shell 415, all connected to the sunlight control panel 413 and electrically connected to the battery 414, and the sunlight control panel 413 is electrically connected to the main controller 50 and configured to transform the collected solar energy into electric energy which is then stored in the battery 414 to drive the main controller 50 and other circuit devices to which power is to be supplied. The sunlight control panel 413 and the main controller 50 are all received within a lower shell 416, and the main controller 50 is connected to other circuits by leads. The middle shell 415 is fixed on the lower shell 416. An upper cover 417 is arranged above the middle shell 415, is of a glass structure, and is configured to protect the internal solar panel 411.

Figure 17:
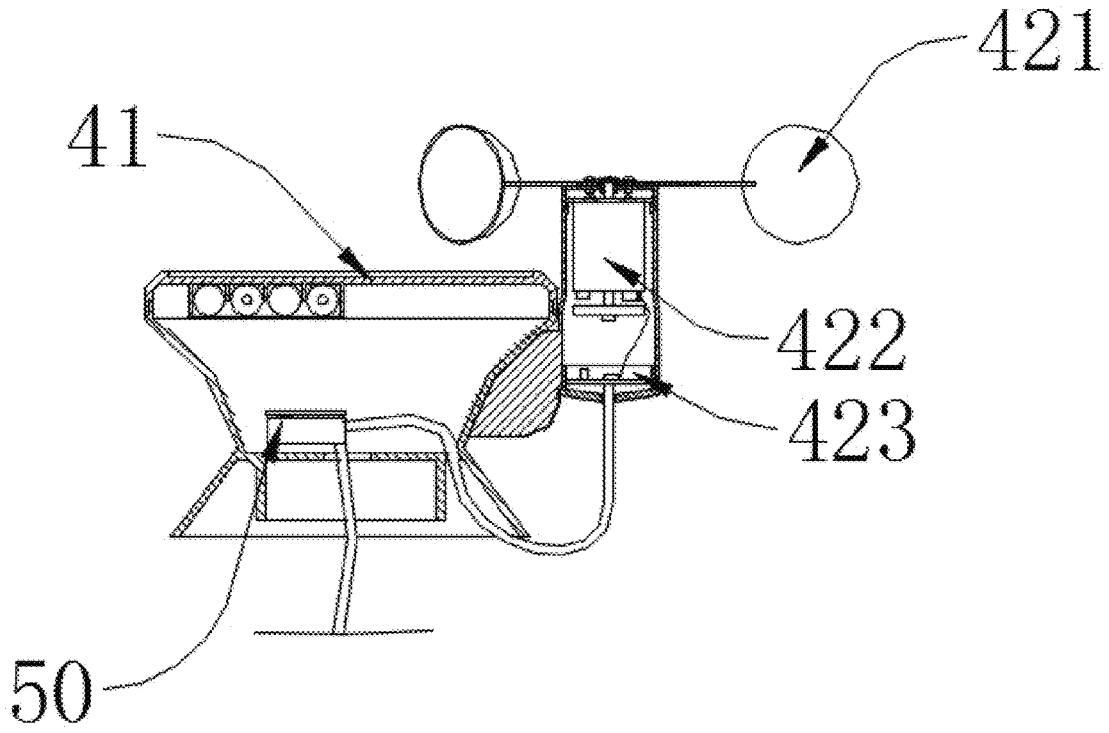
FIG. 17 is a schematic structure diagram of an environment monitoring mechanism according to the present invention.

Further, referring to FIG. 17, the environment monitoring mechanism 40 comprises a wind speed measurement device 42 comprising a wind measurement vane 421, a frequency identification module 422 and a wind speed sensing module 423. The wind measurement vane 421 is connected to the frequency identification module 422, and the frequency identification module 422 and the wind speed sensing module 423 are both electrically connected to the main controller 50 by leads and transfer the monitored wind speed information to adjust the angle of an umbrella cover.

With such a structure, the angle adjustment mechanism 20, the lifting mechanism 30 and the rotation mechanism 60 in the present invention can operate separately and can be controlled manually. For example, the umbrella frame 12 is controlled to fold and unfold by the crank 14, the position of the umbrella frame 12 is adjusted by adjusting the position of the lower connecting rod 23A, and the whole umbrella stem 13 is controlled to rotate by 360 degrees by the tray brake 634A. Each component operates separately according to the specific situation and requirement. Also, the components can be controlled separately or synchronously according to the external environment, under the monitoring of the environment monitoring mechanism 40 and by using an internal control program. For example, when the wind speed reaches a certain preset value, the umbrella frame 12 will not unfold; when the sunlight doesn't reach a preset value, the umbrella frame 12 will not unfold; and when the sunlight incomes from the east, the umbrella frame 12 is controlled to rotate to the east, thus better shading the sunlight. The umbrella frame 12 can perform shading by 360 degrees by the combined action of the angle adjustment mechanism 20 and the rotation mechanism 60, and the shading effect is great.

Further, in addition to the control ways described above, a wireless communication module (not shown) can be provided on the main controller 50. The wireless communication module wirelessly communicates with a remote client, for example, it is connected to a mobile phone, a tablet or a computer, and related environmental parameters and related action parameters received in the main controller 50 are received and monitored to better know the operation state of the outdoor umbrella in the current state. Meanwhile, the operation of each component of the outdoor umbrella can be remotely controlled by a remote control terminal. There is no need for manual operation and the outdoor umbrella is controlled intelligently. Therefore, one client can control multiple outdoor umbrellas and the operation is simple and convenient.

The embodiments are merely used for explaining the present invention, without introducing any limitations thereto. Modifications may be made by those skilled in the art to those embodiments without creative contribution if necessary upon reading the specification, and those modifications shall be protected by the patent law as long as they fall into the scope defined in the appended claims of the present invention.

What is claimed is:

1. An intelligent outdoor umbrella, wherein the umbrella comprises an umbrella body, an angle adjustment mechanism, a lifting mechanism and an environmental monitoring mechanism and a main controller, wherein:

the umbrella body comprises an umbrella fabric, an umbrella frame and an umbrella stem, wherein the umbrella frame is arranged at one end of the umbrella stem, the umbrella fabric is covered on the umbrella frame, and the umbrella frame folds and unfolds relative to the umbrella stem to drive the umbrella fabric to fold and unfold;

the angle adjustment mechanism is arranged on the umbrella stem and is configured to drive the umbrella frame and the umbrella fabric to be angularly connected relative to the umbrella stem in a vertical direction;

the lifting mechanism is arranged on the umbrella stem and configured to control folding and unfolding of the umbrella frame;

the environment monitoring mechanism is configured to monitor a direction of external sunlight and a change in wind speed, wherein the environment monitoring mechanism is arranged on the top of the umbrella frame, located outside of the umbrella fabric and electrically connected to the main controller; and the main controller is configured to receive data from the environment monitoring mechanism and control operation of the angle adjustment mechanism and the lifting mechanism according to the data;

the angle adjustment mechanism comprises a pushrod, an upper connecting rod, a lower connecting rod, an upper connector and a lower connector; the upper connector is hinged to the lower connector by a connecting pin;

the upper connector is fixedly connected to the upper connecting rod, and the lower connector is fixedly connected to the lower connecting rod;

the pushrod comprises a pushrod body and a telescopic rod;

the pushrod body is connected to the lower connecting rod, and one end of the telescopic rod is inserted into the pushrod body and the other end thereof is fixedly connected to the upper connecting rod;

the pushrod is connected to the main controller, and the main controller controls the telescopic movement of the telescopic rod in an up-down direction within the pushrod body to control the upper connecting rod to rotate relative to the lower connecting rod to adjust an angle of the umbrella frame and the umbrella fabric relative to the ground.

2. The intelligent outdoor umbrella of claim 1, wherein the umbrella stem comprises an upper umbrella stem and a lower umbrella stem;

one end of the upper umbrella stem is connected to the upper connecting rod and the other end thereof is connected to the umbrella frame;

the lower connecting rod is sheathed on the lower umbrella stem on which a pushrod fixing hole is formed;

a fixing pin and a fixing pin hole are provided on the lower connecting rod; and the pushrod fixing hole is aligned with the fixing pin hole, and the fixing pin is inserted so that the lower connecting rod is fixed on the lower umbrella stem.

3. The intelligent outdoor umbrella of claim 2, wherein multiple pushrod fixing holes arranged top and bottom, are formed on the lower umbrella stem, and the fixing pin hole is manually aligned with a pushrod fixing hole to adjust an angle of the umbrella frame and the umbrella fabric relative to the ground.

4. The intelligent outdoor umbrella of claim 1, wherein the lifting mechanism comprises a clutch motor, a gear assembly and a screw assembly, wherein one end of the screw assembly is connected to the umbrella frame and the other end thereof is connected to the gear assembly, and the clutch motor is connected to the gear assembly;

the clutch motor is electrically connected to the main controller; and the clutch motor controls the gear assembly to rotate in turn and drives the screw assembly to move up and down in aid of a bearing, thus driving the umbrella frame to fold or unfold.

5. The intelligent outdoor umbrella of claim 4, wherein the gear assembly comprises a first gear in the middle, a second gear and a third gear which are respectively at two ends, and a gear sleeve for receiving the first gear, the second gear and the third gear;

a thread structure is provided inside the gear sleeve, the second gear is connected to the screw assembly, and the first gear is perpendicular to and engaged with the thread structure on the gear sleeve;

the second gear and the third gear are both engaged with the first gear and the third gear is connected to the clutch motor;

the clutch motor controls the third gear to rotate, the third gear drives the first gear to rotate, and the first gear drives the second gear to rotate, thus controlling the screw assembly to move up and down.

6. The intelligent outdoor umbrella of claim 5, wherein the first gear is connected to a connecting shaft and the connecting shaft is connected to a crank provided on the umbrella stem;

when the crank is rotated, the first gear is driven to rotate, and the first gear drives the second gear to rotate, thus driving the screw assembly to move up and down.

7. The intelligent outdoor umbrella of claim 1, wherein the environment monitoring mechanism comprises a solar assembly comprising a solar panel, a light sensor, a sunlight control panel and a battery, wherein the sunlight control panel is electrically connected to the main controller and configured to transform the collected solar energy into electric energy which is then stored in the battery to drive the main controller, and the sunlight control panel transfers light information detected by the light sensor to the main controller.

8. The intelligent outdoor umbrella of claim 1, wherein the environment monitoring mechanism comprises a wind speed measurement device comprising a wind measurement vane, a frequency identification module and a wind speed sensing module, wherein the wind measurement vane is connected to the frequency identification module, and the frequency identification module and the wind speed sensing module are both connected to the main controller and transfer the monitored wind speed information.

9. The intelligent outdoor umbrella of claim 1, wherein a wireless communication module is provided within the main controller and the wireless communication module wirelessly communicates with a remote client.

* * * * *